US005865527A

United States Patent [19]

Lemons et al.

[11] Patent Number: 5,865,527

[45] **Date of Patent: *Feb. 2, 1999**

[54] EMERGENCY STROBE LIGHT

[75] Inventors: Thomas M. Lemons, Marblehead; Lawrence J. Feroli, West Townsend, both of Mass.

[73] Assignee: Simplex Time Recorder Co., Gardner, Mass.

[ * ] Notice: The term of this patent shall not extend beyond the expiration date of Pat. No. 5,622,427.

[21] Appl. No.: 840,806

[22] Filed: Apr. 16, 1997

Related U.S. Application Data

[63] Continuation of Ser. No. 537,413, Oct. 10, 1995, Pat. No. 5,622,427, which is a continuation of Ser. No. 116,715, Sep. 3, 1993, abandoned.

[51] Int. Cl.[6] ..... F21V 7/00

[52] U.S. Cl. ..... 362/298; 362/301; 362/346

[58] Field of Search ..... 362/297, 298, 362/300, 301, 263, 346, 351, 361, 363; 340/331, 471, 472; 313/313; 359/850, 851; 315/200 A, 241 S

[56] References Cited

U.S. PATENT DOCUMENTS

| | | | |
|---|---|---|---|
| 330,742 | 11/1885 | Scovil et al. | 362/346 |
| 678,942 | 7/1901 | Cox . | |
| 823,392 | 6/1906 | Burnfield . | |
| 1,224,189 | 5/1917 | Maltby . | |
| 1,365,319 | 1/1921 | Hazard . | |
| 1,658,265 | 2/1928 | Thompson . | |
| 1,903,330 | 4/1933 | Young et al. . | |
| 1,950,380 | 3/1934 | Arras . | |
| 2,137,089 | 11/1938 | Kraut et al. | 240/25 |
| 3,710,095 | 1/1973 | Donohue et al. | 359/851 |
| 4,153,929 | 5/1979 | Laudenschlarger et al. | 359/851 |
| 4,308,573 | 12/1981 | McNamara | 362/297 |
| 4,409,646 | 10/1983 | Baliozian | 362/319 |
| 4,428,038 | 1/1984 | Rakitsch et al. | 362/263 |
| 4,481,563 | 11/1984 | Snyder et al. | 362/296 |
| 4,580,201 | 4/1986 | Williams | 315/241 S |
| 4,928,214 | 5/1990 | Oyama | 362/61 |
| 4,954,938 | 9/1990 | Lyons | 362/298 |
| 4,979,086 | 12/1990 | Heinisch | 362/297 |
| 5,032,758 | 7/1991 | Davensport et al. | 313/113 |
| 5,045,982 | 9/1991 | Lyons | 362/241 |
| 5,347,259 | 9/1994 | Jongewaard | 340/331 |
| 5,390,095 | 2/1995 | Lemons et al. | 362/297 |
| 5,475,361 | 12/1995 | Curran et al. | 340/331 |
| 5,488,462 | 1/1996 | Moran, III | 362/297 |
| 5,546,293 | 8/1996 | Moran, III | 362/297 |
| 5,622,427 | 4/1997 | Lemons et al. | 362/300 |

*Primary Examiner*—Stephen Husar
*Attorney, Agent, or Firm*—Hamilton, Brook, Smith & Reynolds, P.C.

[57] ABSTRACT

An emergency strobe light for warning the hearing impaired of emergency situations includes a bulb extending outwardly from a base along an axis. Reflectors extending outwardly from the base direct a high percentage of light output from the bulb along a horizontal plane and a vertical plane which intersect each other along the axis of the bulb. The strobe light draws little power and can be powered by a battery.

6 Claims, 5 Drawing Sheets

EMERGENCY STROBE LIGHT

This application is a continuation of application Ser. No. 08/537,413 filed Oct. 10, 1995 now U.S. Pat. No. 5,622,427 which is a File Wrapper Continuation of Ser. No. 08/116,715 filed Sep. 3, 1993.

BACKGROUND

Warning lights are often used within buildings in conjunction with audio warning alarms so that the hearing impaired can be alerted to emergency conditions such as a fire. Typically, the warning light includes a flashing bulb positioned horizontally within a reflector. A Fresnel lens may be used to spread the reflected light. The bulb may be powered by a battery source to ensure that the warning light will have power in the event power to the building is disrupted.

Warning lights approved by Underwriters Laboratories (UL) are subject to light intensity requirements. Underwriters Laboratories measures the light intensity of a warning light being tested along intersecting horizontal and vertical planes which extend outwardly from the base of the warning light. The standards are found in UL 1971 (and UL 1638), "Standard for Safety Signalling Devices for the Hearing Impaired." These standards provide that the light intensity emitted by a warning light at a given angle on each of the horizontal and vertical planes must be at a certain level at a distance of 10 feet. The UL standards provide for a maximum light intensity output of 110 candela-sec at 10 ft. for ceiling and wall mounted warning lights along an axis defined by the intersection of the horizontal and vertical planes. The UL Standards provide for lesser light intensities at angles away from the axis.

SUMMARY OF THE INVENTION

In order for a conventional warning light to generate enough light along the horizontal and vertical planes to meet the light intensity standards set forth by Underwriters Laboratories, the warning light must draw a considerable amount of power. As a result, a typical warning light meeting UL light intensity standards cannot be powered by a battery for an acceptable amount of time.

Accordingly, there is a need for an efficient battery powered warning light which attains the light intensity levels required by Underwriters Laboratories while drawing little power so that the warning light can be operated for a sufficient amount of time.

The present invention provides an emergency strobe light or luminaire which includes a bulb extending outwardly from a base along an axis. Reflectors direct a high percentage of light output from the bulb substantially along a first orthogonal or horizontal plane and a second orthogonal or vertical plane. The two orthogonal planes intersect along the axis of the bulb. Preferably, at least 70 per cent of the light output of the bulb is directed by the reflectors substantially along the orthogonal planes.

In preferred embodiments, the strobe light meets UL light intensity requirements 1971 for a ceiling mounted light while drawing less than about 150 milliamps, preferably less than 100 milliamps, and less than 2.4 watts so that it can be powered by a battery for a sufficient amount of time during an emergency situation. The strobe light also meets the UL requirements for a wall mounted light by providing a higher light level at 30° from the axis of the bulb.

The bulb is a low power bulb and the reflectors are arranged to direct the light from the bulb with greatest intensity in regions near the axis of the bulb. The reflectors include a complex reflector positioned along the first orthogonal plane for directing light primarily along the first orthogonal plane. Another complex reflector is positioned along the second orthogonal plane for directing light primarily along the second orthogonal plane. Upright reflectors, offset from the two planes, extend outwardly from the base and direct light in opposite directions primarily along the first orthogonal plane in directions near orthogonal to the axis of the bulb. Additional upright reflectors, offset from the two planes, extend outwardly from the base and direct light in opposite directions primarily along the second orthogonal plane in directions near orthogonal to the axis of the bulb. Other reflectors, offset from the two planes, extend outwardly from the base and direct light in opposite directions, at intermediate angles relative to the axis of the bulb in both planes.

Reflectors are more preferable than refractors because less light is lost with reflectors. The use of reflectors which direct light past each other in opposite directions are preferable because positioning four parabolic reflectors for directing light away from the bulb would be difficult given space constraints.

The preferred emergency strobe light further includes a transparent non-focusing cover for enclosing the reflectors and through which light directed from the bulb by the reflectors passes. An electrode extends outwardly from the bulb along the axis of the bulb and engages a hole within the transparent non-focusing cover to stabilize and position the bulb. A lead connected to the electrode extends from the electrode in a substantially perpendicular direction and passes through a notch formed in a reflector to electrically isolate the bulb.

BRIEF DESCRIPTION OF THE DRAWINGS

The foregoing and other objects, features and advantages of the invention will be apparent from the following more particular description of preferred embodiments of the drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENT

Figure 1:
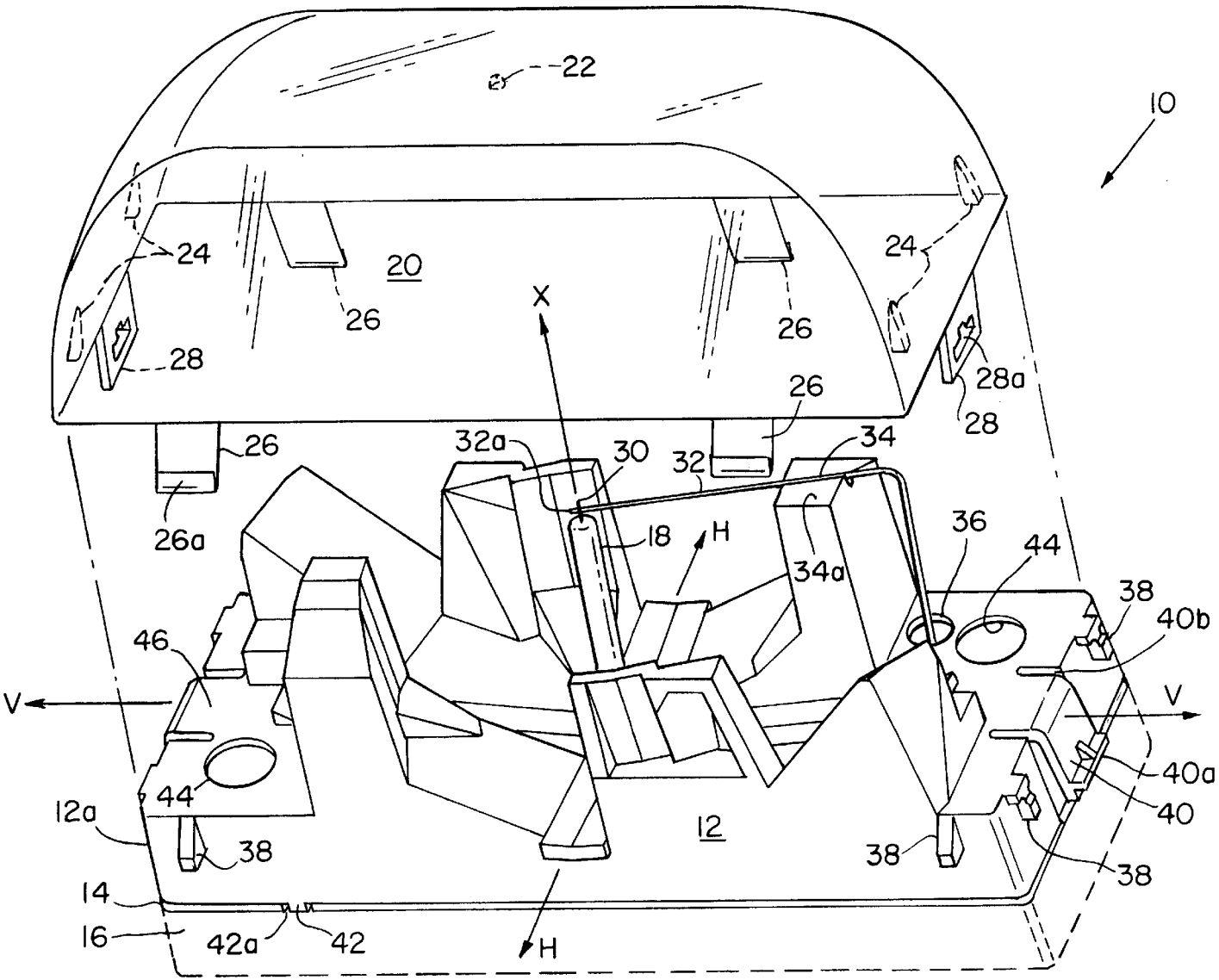
FIG. 1 is an exploded perspective view of the present invention emergency strobe light.
Figure 2A:
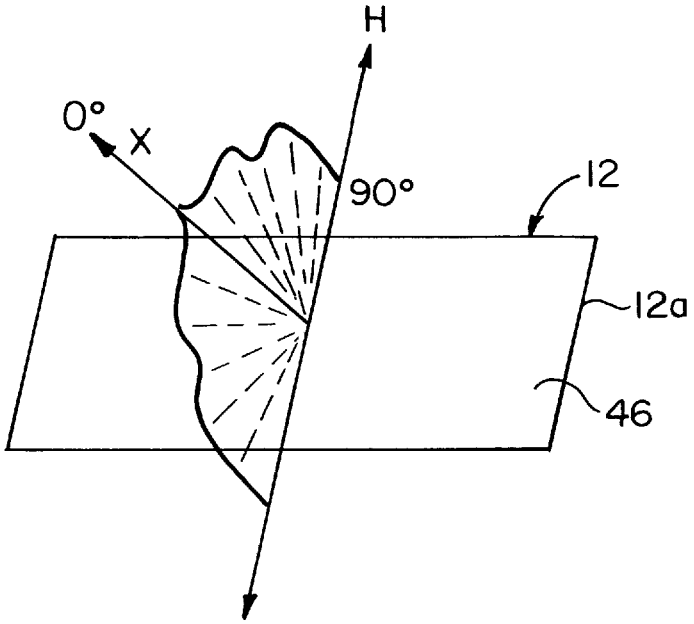
FIGS. 2*a* and 2*b* are schematic drawings showing the distribution of light produced by the present invention emergency strobe light along two orthogonal planes.
Figure 2B:
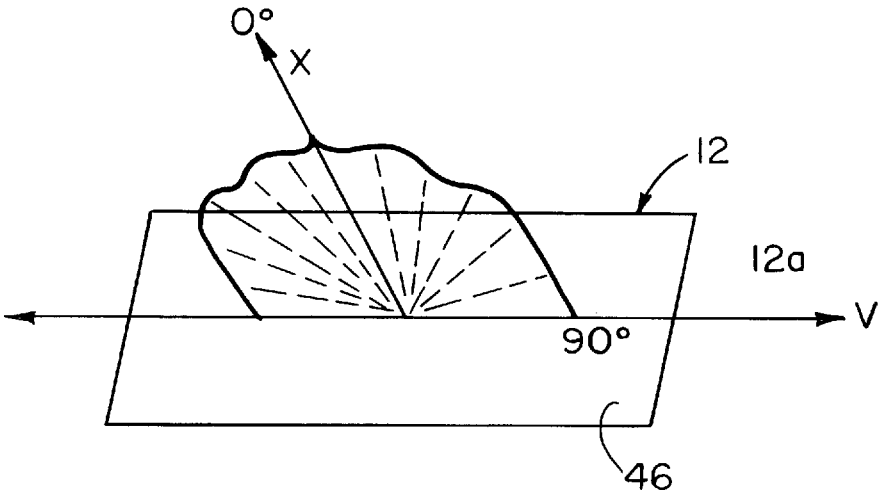

In FIG. 1, strobe light 10 includes a bulb 18 which extends outwardly along axis X from reflector 12. Reflector 12 has a base 12*a* with a top surface 46, from which a series of complex reflector panels extend outwardly. Reflector 12 is coated with a metallic reflective coating which directs light outwardly from bulb 18, principally along two orthogonal planes, a horizontal plane Hx and a vertical plane Vx extending from reflector 12 as depicted in FIGS. 2*a* and 2*b*. Horizontal plane Hx and vertical plane Vx intersect along axis X. Reflector 12 is mounted upon circuit board 14 which contains the electronic components 16 to strobe bulb 18. Finally, a transparent non-focusing cover 20 encloses and protects reflector 12.

Holes 44 allow reflector 12 to be secured to circuit board 14 with plastic rivets. Protrusion 42 and recess 42*a* provide gross alignment of circuit board 14 with reflector 12. Additional pins or protrusions extending from reflector 12 provide accurate alignment with holes or recesses in circuit board 14, therefore, providing accurate alignment of bulb 18 and reflector 12.

Figure 4:
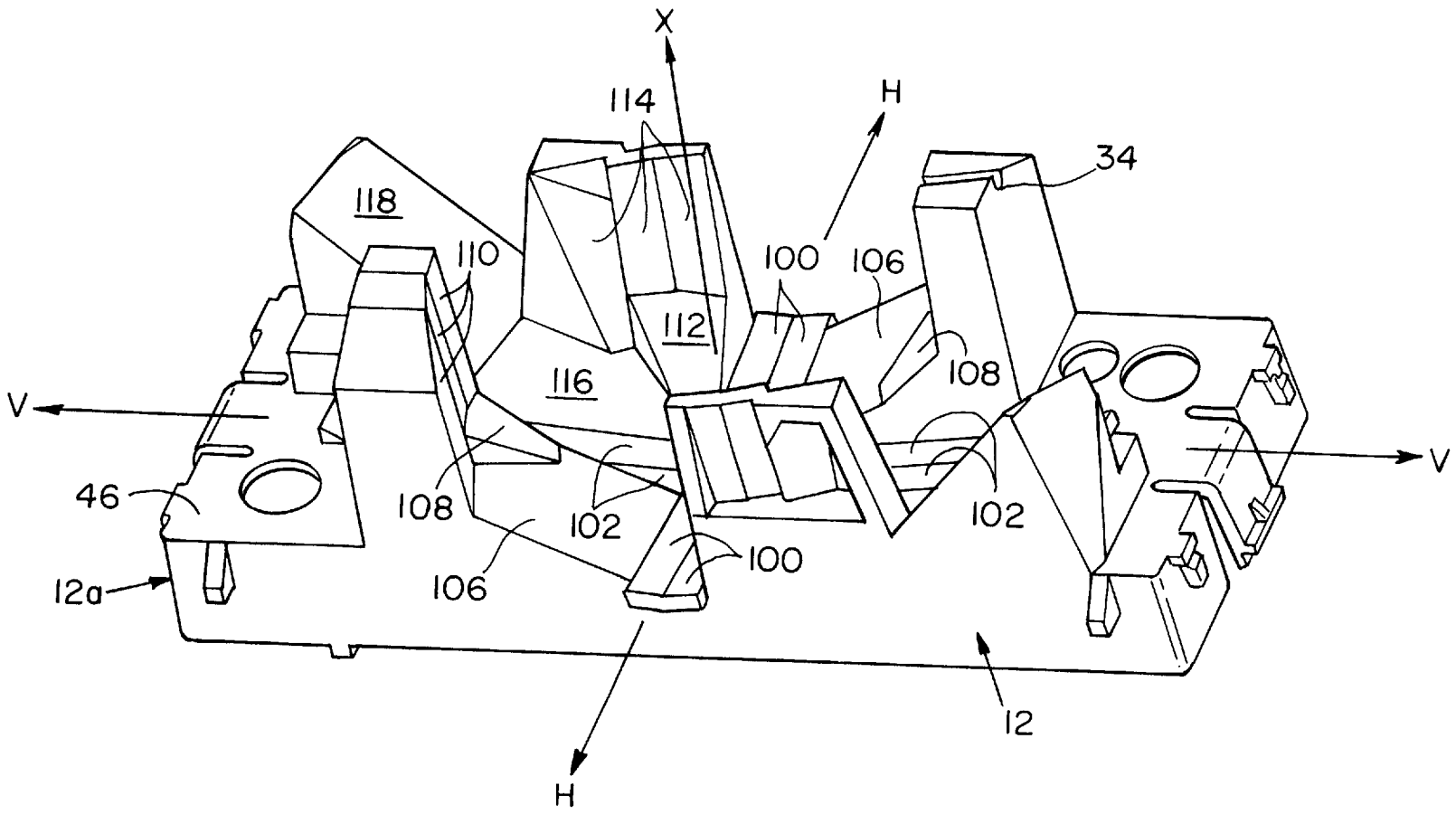
FIG. 4 is a perspective view of the reflector.

The lower end of bulb 18 is affixed and electrically connected to circuit board 14 with the upper end extending through hole 120 in reflector 12 (FIG. 4). An electrode 30 protrudes from the upper end of bulb 18 and is connected to a lead wire 34. Lead wire 32 extends substantially perpendicular to electrode 30 and passes through groove 34 on top surface 34*a*. This electrically isolates bulb 18. Lead 32 bends at a right angle and passes through hole 36 of reflector 12 to be electrically connected to circuit board 14, thus completing the electrical circuit of bulb 18. Hole 120 has a notch 120*a* which allows the tip 32*a* of lead 32 to pass through reflector 12 during assembly.

Bulb 18 is preferably a low power xenon flash tube having a 40 candela-sec output. Bulb 18 flashes every 2.4 seconds and draws 100 milliamps or less of current. This allows strobe light 10 to be powered by battery for a sufficient amount of time. Alternatively, bulb 18 can be of other suitable types with varying specifications.

In order to obtain the required 110 candela-sec peak intensity, and preferably 150 candela-sec, with a bulb having a peak output of 40 candela-sec, reflectors are used to concentrate the bulb output. Specifically, the light is concentrated along the horizontal plane Hx and vertical plane Vx. To concentrate the light in both planes symmetrically, the bulb is oriented upright along the axis X. However, that orientation results in very little light being directed along the axis X directly from the bulb, and it is along that axis where the greatest intensity of over 110 candela-sec is required. Accordingly, virtually all of the light directed along the axis X is concentrated along that axis by reflectors.

Figure 3:
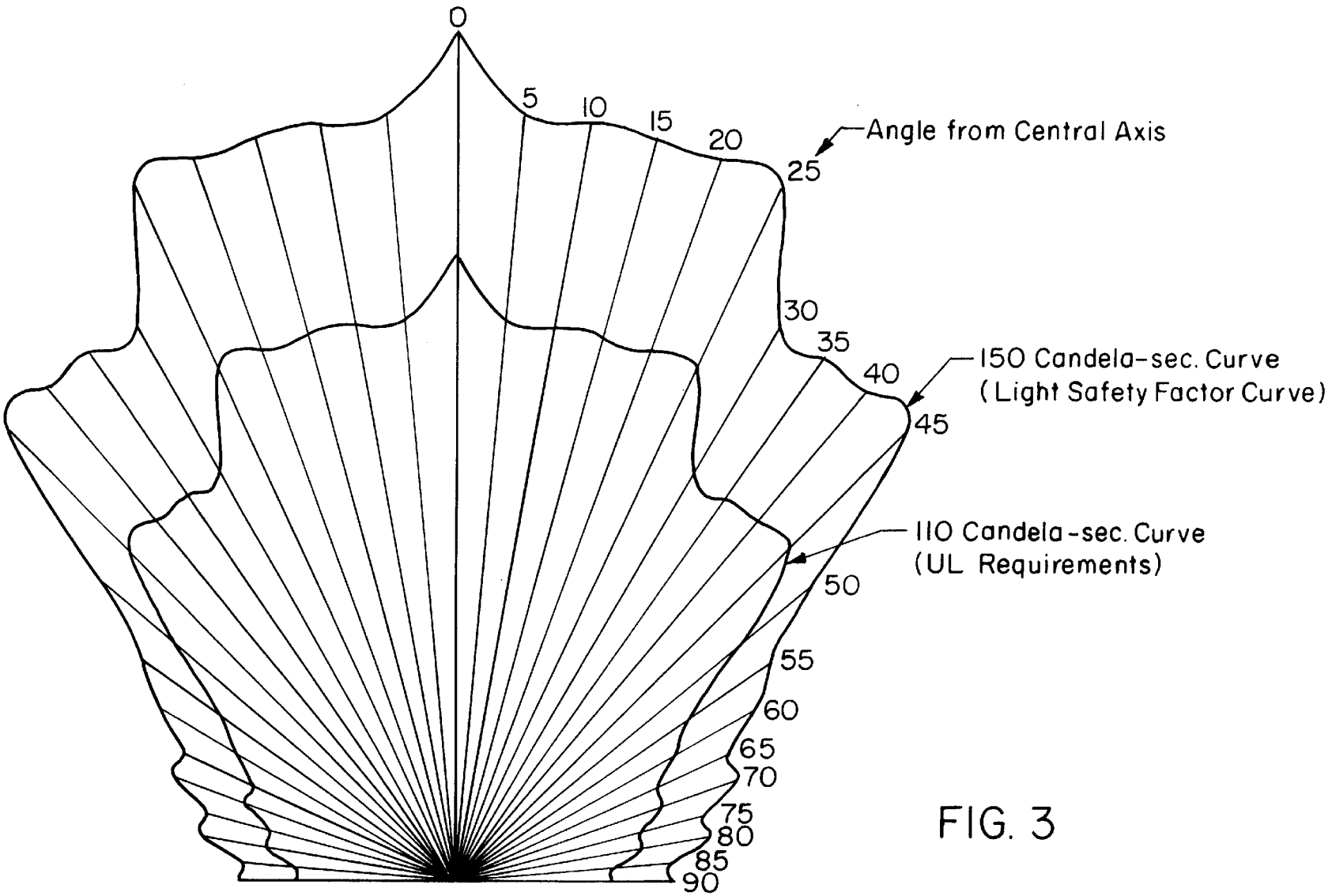
FIG. 3 is a graph showing the light intensity dispersion profile produced by the present invention versus the light intensity dispersion profile required by Underwriters Laboratories along each plane of a ceiling mounted strobe.

Reflector 12 focuses the light from bulb 18 to obtain a light intensity dispersion profile (the 150 candela-sec curve) along the horizontal plane Hx and vertical plane Vx as depicted in FIG. 3. The light intensity for this profile is greatest at axis X (0°) with an intensity of 150 candela-sec. Light intensities are lesser at angles away from axis X. At least 70% of the light output by bulb 18 is directed by reflector 12 substantially along the horizontal plane Hx and the vertical plane Vx.

FIG. 3 depicts the light intensity dispersion profiles at a 10 ft. distance in the horizontal Hx and vertical Vx planes for the UL standard for ceiling mounted warning lights (110 candela-sec curve) as well as for the light for which strobe light 10 is designed to provide a reasonable safety factor over the UL limits (150 candela-sec curve). The UL light intensity requirement as seen in the 110 candela-sec curve is greatest at 0° where the value must be at least 110 candela-sec. The UL standard for ceiling mounted warning lights is stricter than those for wall mounted ones, except at an angle of 30 degrees from the axis X in the vertical plane Vx. The UL standard for a wall mounted light at 30° in the vertical plane Vx, is 99 candela-sec while the UL standard for a ceiling mounted light at 30° in the vertical plane is 82.5 candela-sec. Therefore, by generating a light intensity dispersion profile as shown, following the ceiling mounted UL profile but boosted in intensity along both planes at 30°, strobe light 10 exceeds the UL light intensity dispersion requirements (110 candela-sec curve) for both a wall mounted light and a ceiling mounted light.

As shown, the light intensity generated by the strobe light 10 varies depending upon the angle of the light from axis X. Table 1 provides the light intensity dispersion figures at each angle from axis X for the UL standard for ceiling mounted warning lights (110 candela-sec curve) and the light intensity safety factor profile generated by strobe light 10 (150 candela-sec curve) with a tolerance factor and boosted at 30° to cover wall mounted requirements as well.

TABLE 1

LIGHT INTENSITY DISPERSION PROFILE

| DEG. | 110 CANDELA-SEC CURVE | 150 CANDELA-SEC SAFETY FACTOR CURVE |
|---|---|---|
| 0 | 110.0 | 150.7 |
| 5 | 99.0 | 135.6 |
| 10 | 99.0 | 135.6 |
| 15 | 99.0 | 135.6 |
| 20 | 99.0 | 135.6 |
| 25 | 99.0 | 135.6 |
| 30 | 82.5 | 135.0 |
| 35 | 82.5 | 113.0 |
| 40 | 82.5 | 113.0 |
| 45 | 82.5 | 113.0 |
| 50 | 60.5 | 82.9 |
| 55 | 49.5 | 67.8 |
| 60 | 44.0 | 60.3 |
| 65 | 38.5 | 52.7 |
| 70 | 38.5 | 52.7 |
| 75 | 33.0 | 45.2 |
| 80 | 33.0 | 45.2 |
| 85 | 27.5 | 37.7 |
| 90 | 27.5 | 37.7 |

Cover 20 is a transparent non-focusing cover which is secured to reflector 12 by two end tabs 28 extending downward from cover 20 at the far ends of cover 20 to engage fingers 40 at the ends of reflector 12. Fingers 40, each defined along its sides by notches 40*b*, extend slightly outward from the ends of reflector 12 and are capable of deflecting towards each other so that protrusions 40*a* can engage holes 28*a* of tabs 28. Cover tabs 24 located on the interior of cover 20, rest on surface 46 to provide support during the assembly process. Base flanges 38 on reflector 12 contact the interior surfaces of cover 20 and center cover 20 about reflector 12. A hole 22 on the interior of cover 20 engages electrode 30 to stabilize and position bulb 18 along axis X and to centrally locate bulb 18 within reflector 12. Side tabs 26 extend downward from the sides of cover 20 and have clips 26*a* for securing cover 20 to a protective housing. In the preferred embodiment, cover 20 is plastic but alternatively can be made of other suitable materials such as glass. Additionally, but less desirably, cover 20 could be a focusing lens.

Figure 5:
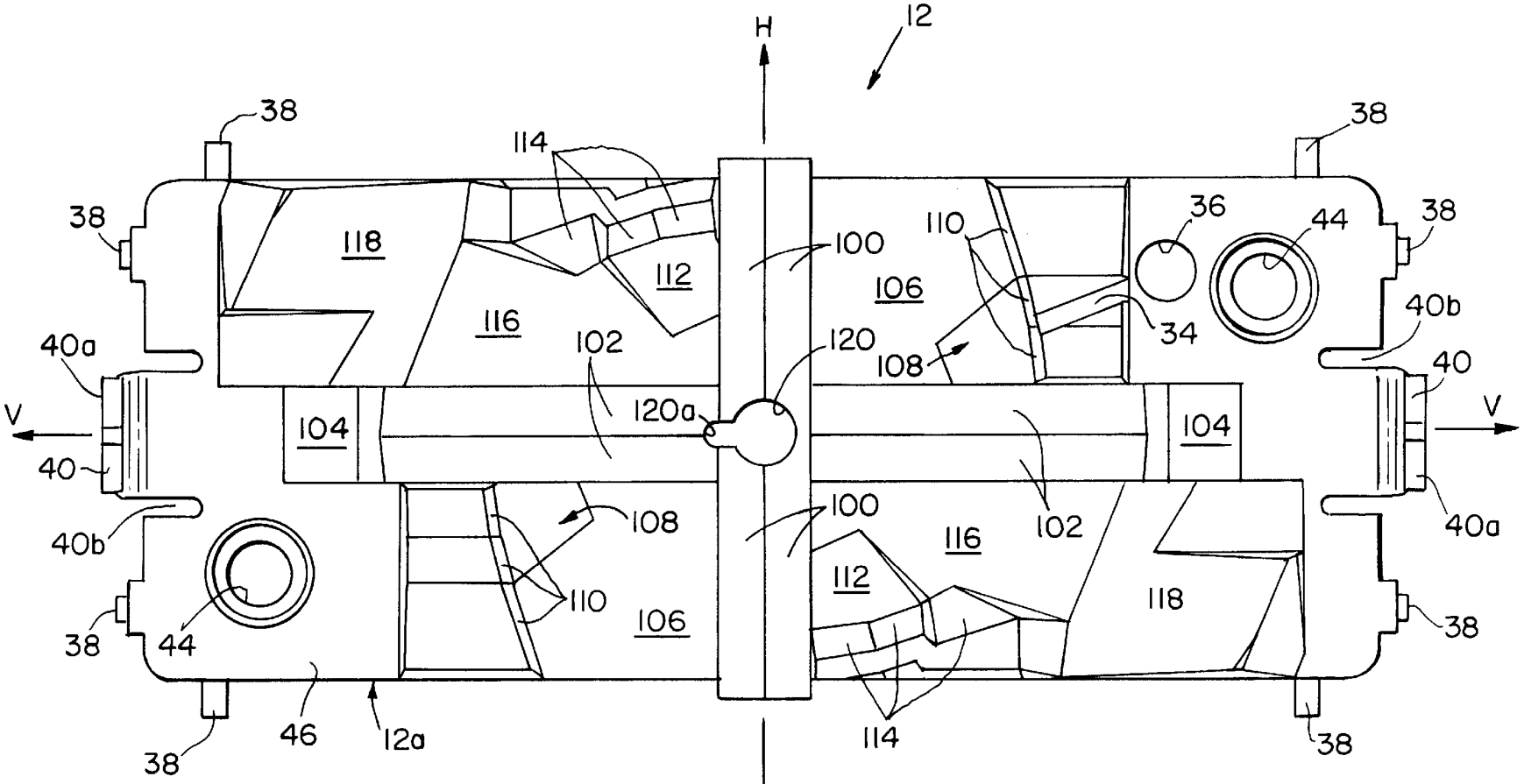
FIG. 5 is a top view of the reflector.

FIGS. 4 and 5 depict reflector 12 in more detail. Reflector 12 includes multiple individual panels positioned at low, intermediate and high or steep angles with respect to surface 46. The panels positioned at low angles with respect to surface 46 reflect light in directions near axis X and the panels positioned at high angles reflect light in directions near orthogonal to axis X. Panels positioned at intermediate angles with respect to surface 46 reflect light in directions intermediate to light reflected by the low and high angled panels.

Planar reflector panels 100 are located along the horizontal plane Hx and are slightly angled toward each other about the horizontal plane Hx and the vertical plane Vx. Panels 100 are positioned at low angles with respect to surface 46 and direct light from bulb 18 primarily along the horizontal plane Hx from about 0° to 60° in respect to axis X. The axis X is designated as 0° in FIGS. 2*a,* 2*b* and 3.

Planar reflector panels 102 and parabolic panels 104 located near the far ends of panels 102 are positioned at low angles with respect to surface 46. Panels 102 are located on the vertical plane Vx of reflector 12 and are angled slightly toward each other about the horizontal plane Hx and the vertical plane Vx. Panels 102 direct light from bulb 18 primarily along the vertical plane Vx from about 0° to 60° in respect to axis X. Parabolic panels 104 are located along the vertical plane Vx and direct light in the horizontal Hx and vertical Vx planes at the central axis X. About 40% of the light output by bulb 18 is reflected by reflector panels 100, 102 and 104.

Planar reflector panels 106, 108, 112, 116 and 118 are positioned at intermediate angles with respect to surface 46 and are offset from the horizontal Hx and vertical Vx planes. These and other upright reflectors are offset from the Hx and Vx planes to permit light to be reflected by them and past them principally to the horizontal Hx and vertical Vx planes, about ten feet from the bulb. Panels 106 direct light along the horizontal plane Hx from about 5° to 40° in respect to axis X. Panels 108 direct light along both the horizontal Hx and vertical Vx planes from about 5° and 10° in respect to axis X. Panels 112 reflect light along both the horizontal Hx and vertical Vx planes from about 5° to 30° in respect to axis X. Panels 116 direct light along the vertical plane Vx from about 5° to 60° in respect to axis X. Panels 118 direct light primarily along the horizontal plane Hx from about 0° to 20° in respect to axis X. Panels 118 also reflect some light along the vertical plane Vx.

Planar reflector panels 110 and 114 are positioned at high or steep angles with respect to surface 46 and are offset from the horizontal Hx and vertical Vx planes so as not to block light along those planes. Panels 110 are steeply angled upright panels which direct light along the vertical plane Vx from about 60° to 90° in respect to axis X. Panels 114 are also steeply angled upright panels which direct light along the horizontal plane Hx from about 60° to 90° in respect to axis X.

The more vertical or steeply angled reflectors direct light closer to 90° from axis X and the reflectors which are oriented more parallel with the base 12*a* direct light closer to 0°. At least ninety percent of the light directed along axis X is reflected. This is due to the fact that bulb 18 does not project a substantial amount of light along axis X. Most of the light reflected along axis X is from reflector panels 100, 102 and 104.

In the preferred embodiment, reflector 12 is a single plastic molded part onto which a reflective metallic coating is deposited to reflect light. The metallic coating is preferably aluminum but, alternatively, other suitable materials and metallic coatings can be used. The dimensions of reflector 12 are preferably about 1.5 inches wide by 4 inches long. All other dimensions shown in FIGS. 4 and 5 are to scale relative to those dimensions.

Although the reflector panels have been described to reflect light along the horizontal Hx and vertical Vx planes between particular angles from axis X, all the surfaces of reflector 12 reflect light from bulb 18 in all directions. Additionally, the range of angles through which the reflector panels direct light can be varied as well as their dimensions. The asymmetry of reflector 12 is due to the fact that reflector 12 is rectangular rather than square. However, reflector 12 can be square and as a result, would be more symmetrical.

Equivalents

While this invention has been particularly shown and described with references to preferred embodiments thereof, it will be understood by those skilled in the art that various changes in form and details may be made therein without departing from the spirit and scope of the invention as defined by the appended claims.

We claim:

1. An emergency strobe light comprising:

a base;

a bulb extending outwardly from the base along an axis; and reflectors for directing a high percentage of light output from the bulb substantially along a first orthogonal plane and a second orthogonal plane, the light along the first orthogonal plane intersecting the light along the second orthogonal plane along the axis of the bulb.

2. The strobe light of claim 1 in which the reflectors are arranged to direct light with greatest intensity in regions near the axis of the bulb.

3. A method for producing light with an emergency strobe light comprising the steps of:

extending a bulb outwardly from a base along an axis;

directing a high percentage of light output from the bulb along a first orthogonal plane and a second orthogonal plane with reflectors, including reflectors extending outwardly from the base, the light along the first orthogonal plane intersecting the light along the second orthogonal plane along the axis of the bulb.

4. The method of claim 3 in which the reflectors direct the light with greatest intensity in regions near the bulb axis.

5. A luminaire for providing illumination in about 180° in a plane comprising:

a base;

a bulb extending outwardly from the base along an axis;

reflectors positioned along the plane for directing substantial light generally parallel with the axis of the bulb along the plane; and upright reflectors offset from the plane for directing light in opposite directions past opposing reflectors primarily along the plane in directions near orthogonal to the axis of the bulb.

6. The luminaire of claim 5 further comprising providing illumination in about 180° in a second plane intersecting and orthogonal to the plane.

* * * * *